US008340553B2

(12) United States Patent
Kidaka

(10) Patent No.: US 8,340,553 B2
(45) Date of Patent: Dec. 25, 2012

(54) IMAGE FORMING APPARATUS INCLUDING CORONA CHARGER

(75) Inventor: Hiroyuki Kidaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 454 days.

(21) Appl. No.: 12/612,261

(22) Filed: Nov. 4, 2009

(65) Prior Publication Data

US 2010/0111554 A1 May 6, 2010

(30) Foreign Application Priority Data

Nov. 5, 2008 (JP) ..... 2008-284514

(51) Int. Cl.
*G03G 15/00* (2006.01)

(52) U.S. Cl. ..... 399/170; 399/50; 399/168; 399/115

(58) Field of Classification Search ..... 399/50, 399/168, 170, 115
See application file for complete search history.

(56) References Cited

U.S. PATENT DOCUMENTS

| | | | | |
|---|---|---|---|---|
| 2008/0038011 | A1* | 2/2008 | Nakajima et al. | 399/100 |
| 2010/0158550 | A1* | 6/2010 | Makino et al. | 399/45 |
| 2010/0158571 | A1* | 6/2010 | Kidaka et al. | 399/170 |
| 2011/0222909 | A1* | 9/2011 | Kidaka | 399/170 |

FOREIGN PATENT DOCUMENTS

| | | | |
|---|---|---|---|
| JP | 2001-175058 A | | 6/2001 |
| JP | 2007-072212 | * | 3/2007 |
| JP | 2007-72212 A | | 3/2007 |

OTHER PUBLICATIONS

Search Report dated Mar. 16, 2010, in related European Application No. 09179677.1-2209.

* cited by examiner

*Primary Examiner* — Walter L Lindsay, Jr.
*Assistant Examiner* — Roy Y Yi
(74) *Attorney, Agent, or Firm* — Fitzpatrick, Cella, Harper & Scinto

(57) ABSTRACT

An image forming apparatus includes a photosensitive member; a corona charger, provided with an opening opposing the photosensitive member, for electrically charging the photosensitive member; image forming means for forming an image on the photosensitive member electrically charged by the corona charger; a sheet-like member for covering and uncovering the opening of the corona charger with respect to the photosensitive member; and control means for controlling a rotating operation of the photosensitive member so as to be started at a predetermined time in a period from start of an opening operation of the sheet-like member for starting image formation to end of the opening operation of the sheet-like member.

5 Claims, 10 Drawing Sheets

(A)

(B)

(A)

(B)

(C)

IMAGE FORMING APPARATUS INCLUDING CORONA CHARGER

FIELD OF THE INVENTION AND RELATED ART

The present invention relates to an image forming apparatus, including a corona charger, such as a copying machine, a printer, a facsimile machine, or a multi-function machine having a plurality of functions of these machines.

In an image forming apparatus of an electrophotographic type, an image has been conventionally formed through an electrophotographic process including steps of charging, exposure, development and transfer. Of these steps, in the charging step a photosensitive member has been electrically charged uniformly to a potential of a predetermined polarity by a corona charger provided closely to the photosensitive member. In the charging step using the corona charger, corona discharge is utilized, so that an electric discharge product such as ozone ($O_3$) or nitrogen oxides ($NO_X$) is generated. When such an electric discharge product is deposited on the photosensitive member and takes up moisture, a so-called "image deletion (flow)" phenomenon such that a surface resistance at a opening on which the electric discharge product is deposited is lowered, thus failing to faithfully reproduce an electrostatic image depending on image information.

Japanese Laid-Open Patent Application (JP-A) 2007-072212 discloses prevention of deposition of the electric discharge product on the photosensitive member during non-image formation by providing a shutter for covering an opening of the corona charger. According to a study by the present inventor, as shown in FIG. 1, in the case where a corona charger 2' is intended to be brought nearer to a photosensitive member 1' compared with a conventional image forming apparatus, it has been found that a sheet-like shutter (sheet-like member) 10' as shown in FIGS. 2(A) and 2(B) may preferably be employed so that the mechanism 1' is not deteriorated even when the shutter 10' can slide on the photosensitive member 1' by the proximity of the corona charger 2'. Incidentally, a reference symbol 2*a*' represents a grid electrode. Further, FIG. 2(A) shows a state in which the opening of the corona charger 2' is covered with the sheet-like shutter 10' and FIG. 2(B) shows a state in which the opening of the corona charger 2' is uncovered with the sheet-like shutter 10'. In FIGS. 2(A) and 2(B), a reference symbol 11' represents a winding-up mechanism for winding up the sheet-like shutter 10' and a reference symbol 12' represents a movable mechanism for moving the sheet-like shutter 10' in a longitudinal direction of the corona charger 2' so as to cover and uncover the opening of the corona charger 2'.

However, in the case where the sheet-like shutter is employed, as shown in FIG. 3, the sheet-like shutter can contact the photosensitive member due to bending of the sheet-like shutter in the neighborhood of a longitudinal central portion of the sheet-like shutter. In this case, when the photosensitive member is rotated for starting the image formation, the sheet-like shutter is dragged in a circumferential direction of the photosensitive member by the rotation of the photosensitive member, so that there is a possibility of an occurrence of an inconvenience such that the sheet-like shutter is broken. This inconvenience can be obviated by employing a constitution in which the rotation of the photosensitive member is started after an opening operation of the sheet-like shutter is completed. However, such a constitution is accompanied with another problem. That is, in the case of the constitution in which the rotation of the mechanism is started after the completion of the opening operation of the sheet-like shutter, a time from receiving of an image forming instruction until the image formation on a first sheet is unnecessarily increased. That is, the above constitution cannot meet needs of a user who wishes to complete the image formation in a short time, thus lowering usability.

SUMMARY OF THE INVENTION

A principal object of the present invention is to provide an image forming apparatus capable of preventing breakage of a sheet-like member during an opening operation of the sheet-like member and capable of reducing a time required for image formation as short as possible.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, the present invention will be described based on embodiments with reference to the drawings.

Embodiment 1

First, a general structure of the image forming apparatus according to the present invention will be described with reference to FIG. 4. The image forming apparatus in this embodiment is a laser beam printer of an electrophotographic type.

(General Structure of Image Forming Apparatus)

Figure 4:
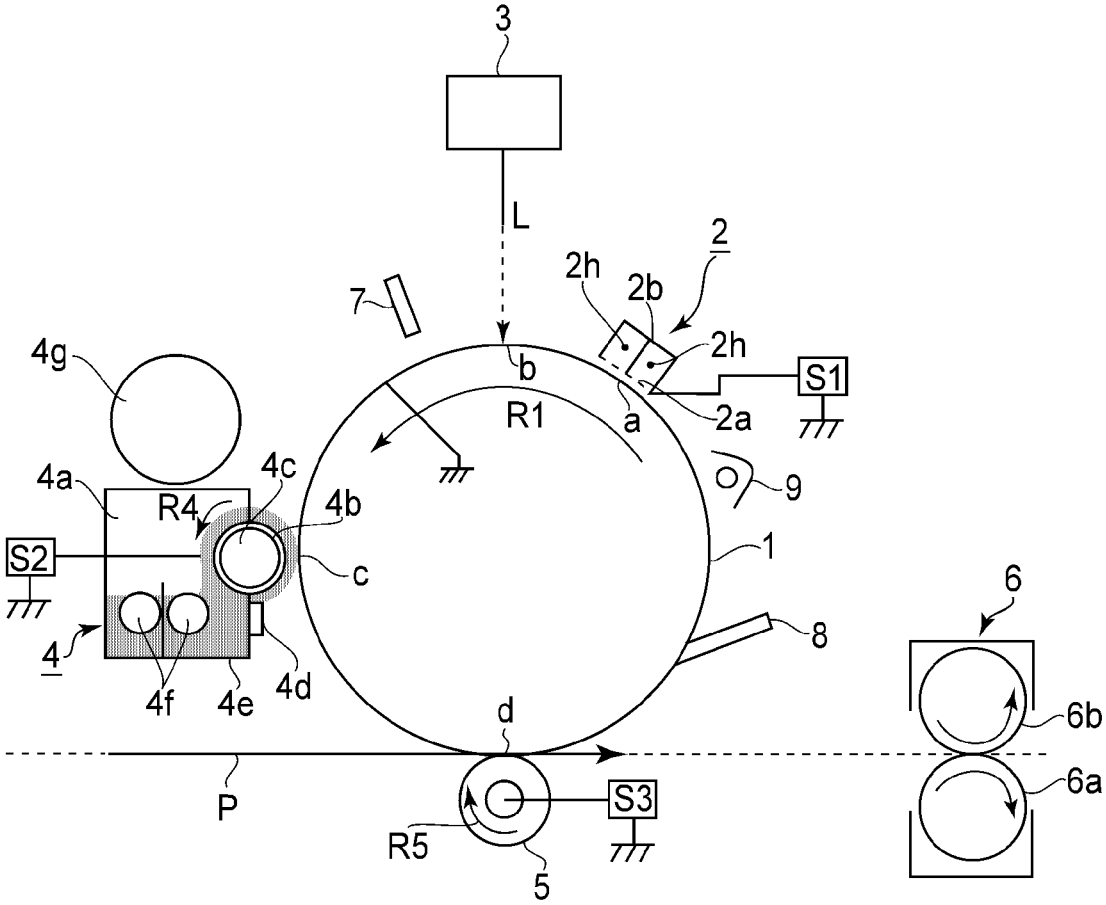
FIG. 4 is a schematic sectional view showing the entire image forming apparatus.

As shown in FIG. 4, a charging device 2, an image exposure device 3, a potential measuring device 7, a developing device 4, a transferring device 5, a cleaning device 8, and an optical discharging device 9 and disposed in this order around a photosensitive member (image bearing member) 1 along a rotational direction (indicated by an arrow R1) of the photosensitive member 1. Further, a fixing device 6 is disposed downstream of the transferring device 5 with respect to a conveying direction of a recording material P.

Next, an individual image forming device associated with image formation will be described specifically.

(Photosensitive Member)

photosensitive member 1 of this embodiment as the image bearing member is a cylindrical (drum-type) electrophotographic photosensitive member as shown in FIG. 4. The photosensitive member 1 has a diameter of 84 mm and is rotationally driven in the arrow R1 direction about a center shaft (not shown) at a process speed (peripheral speed) of 500 mm/sec.

Figure 5:
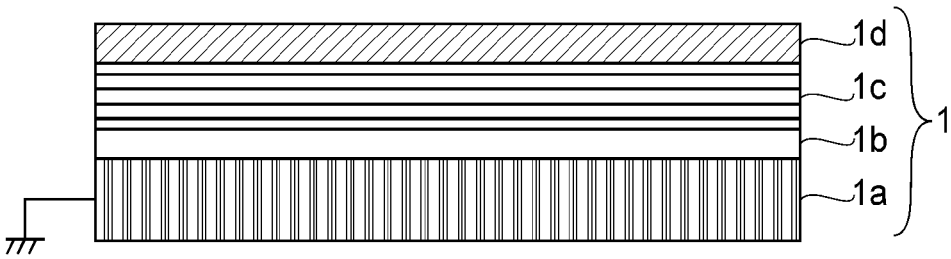
FIG. 5 is a schematic sectional view showing a layer structure of a photosensitive member.

Further, as shown in FIG. 5, the photosensitive member 1 includes a photosensitive layer of a negatively chargeable organic photoconductor. Specifically, the photosensitive member 1 includes an aluminum cylinder 1*a* as an electroconductive support at an inner position with respect to a radial direction (a lower portion in FIG. 4). On the cylinder 1*a*, a three-layer structure consisting of an under coat layer 1*b* for suppressing interference of light and improving an adhesiveness with an upper layer, a charge generation layer 1*c*, and a charge transport layer 1*d* is formed. The charge generation layer 1*c* and the charge transport layer 1*d* constitute the photosensitive layer described above.

(Charging Device)

Figure 1:
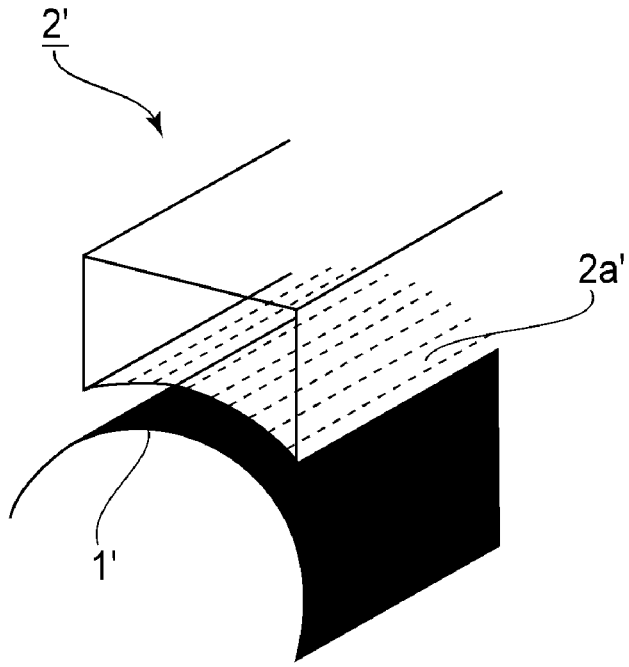
FIG. 1 is a schematic perspective view showing an state in which a corona charger is disposed closely to a photosensitive member.
Figure 3:
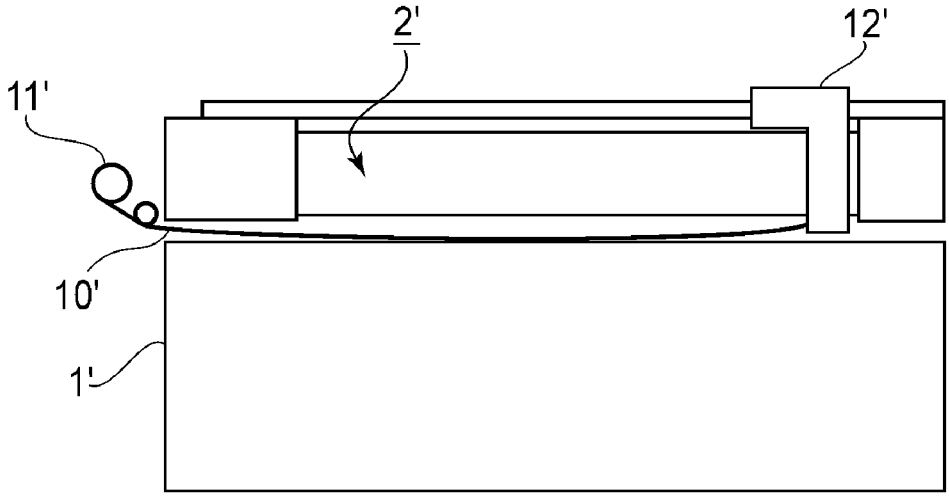
FIG. 3 is a schematic sectional view showing a state in which the charger shutter located at a closed position is bent.
Figure 2:
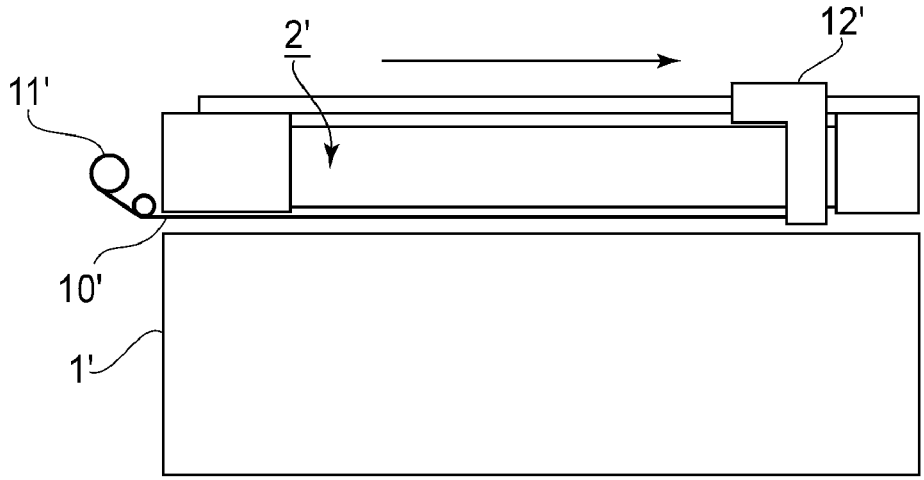
FIG. 2(A) is a schematic sectional view showing a state in which a charger shutter is closed and FIG. 2(B) is a schematic sectional view showing a state in which the charger shutter is opened.
Figure 2:
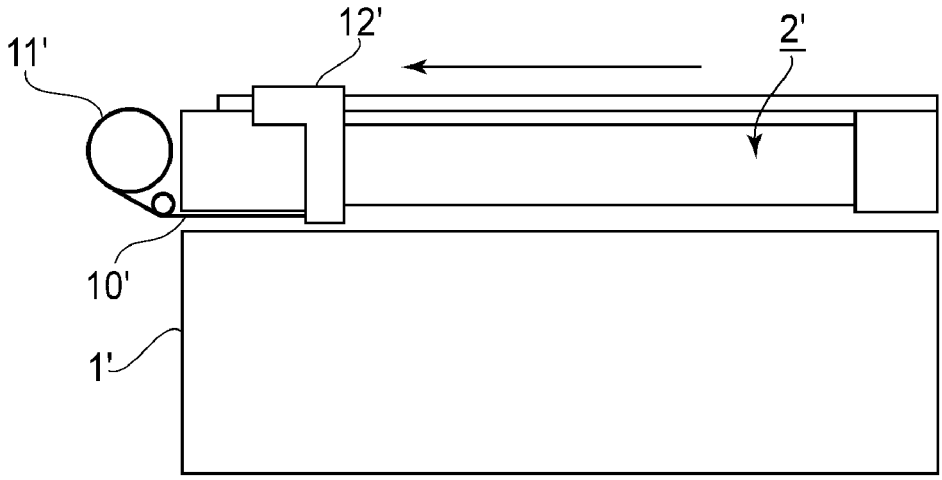
Figure 7:
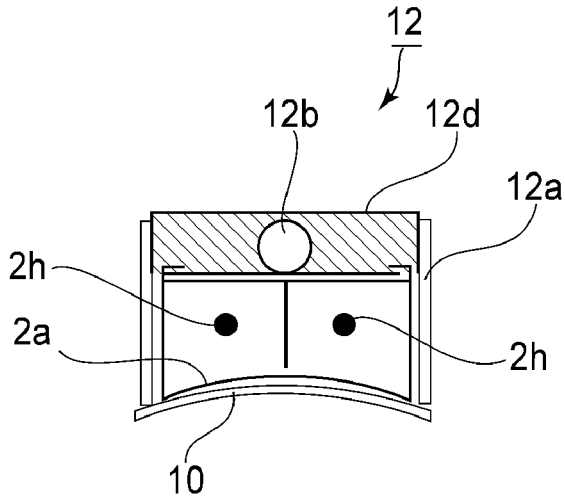
FIG. 7(A) is a schematic sectional view of a corona charger.
FIG. 7(B) is a schematic perspective view of a charger shutter movable mechanism.
FIG. 7(C) is a schematic sectional view of a corona charger winding-up mechanism.
Figure 7:
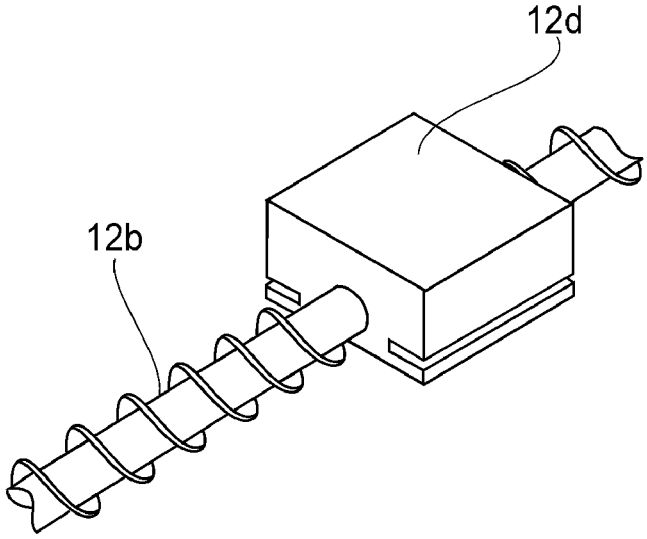
Figure 7:
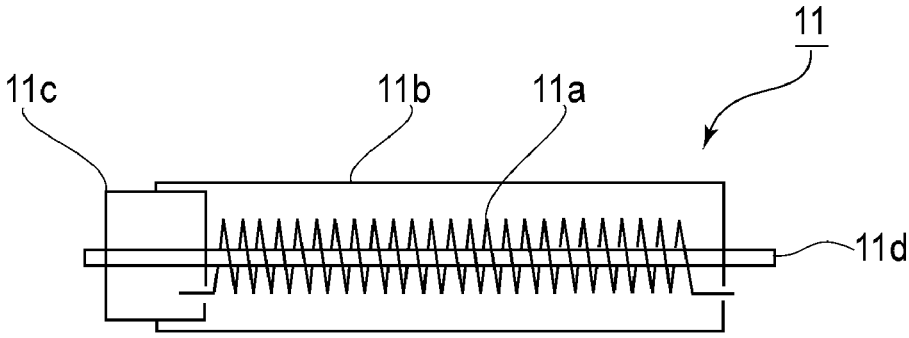

The charging device 2 in this embodiment is, as shown in FIG. 4, a corona charger of a scorotron type including a discharging wire 2*h*, an electroconductive shield 2*b* which is provided so as to surround the discharging wire with an opening facing the photosensitive member (photosensitive drum), and a grid electrode 2*a* provided at the opening facing the photosensitive member. In this embodiment, in order to meet high-speed image formation, the corona charger 2 includes two discharging wires 2*h* and a partition wall provided between the two discharging wires 2*h*. The corona charger 2 is provided along a generatrix direction of the photosensitive member 1. Therefore, a longitudinal direction of the corona charger 2 is parallel to an axial (shaft) direction of the photosensitive member 1. Further, as shown in FIG. 7(A), the grid electrode 2*a* is disposed, similarly as in FIG. 1, along the peripheral surface of the photosensitive member so that a central portion thereof with respect to a widthwise (lateral) direction (a photosensitive member movement direction) is separated from the photosensitive member in a larger distance than that at both end portions thereof. Therefore, in this embodiment, compared with the conventional image forming apparatus, the corona charger 2 can be brought nearer to the photosensitive member 1 (with a gap between the grid electrode and the photosensitive member of about 1 mm), so that a charging efficiency can be improved.

Further, to the corona charger 2, a charging bias application source S1 for applying a charging bias is connected, so that the corona charger 2 has the function of uniformly charging the surface of the photosensitive member 1 to a potential of a negative polarity at a charging position a by the charging bias applied from the application source S1. Specifically, the charging bias in the form of a DC voltage biased with an AC voltage is applied to the discharging wires 2*h* and the grid electrode 2*a*. Further, to the corona charger 2, a charger shutter 10 for covering and uncovering the opening provided to the shield 2*d* is provided. Details thereof will be described later. An image forming means for forming a toner image on the photosensitive member 1 charged by the corona charger 2 will be described. Specifically, the function as the image forming means is performed by the image exposure device 3 and the developing device 4 which are described specifically later. The function as the image forming means is also performed by the cleaning device 8 and the optical discharging device 9 which are configured to remove an image history (untransferred toner, potential history) left on the photosensitive member.

(Image Exposure Device)

The image exposure device 3 in this embodiment is a laser beam scanner including a semiconductor laser for irradiating the photosensitive member 1 charged by the corona charger 2 with laser light L. Specifically, on the basis of image information contained in signals sent from a host computer (an external device) connected to the image forming apparatus through a network cable, the image exposure device 3 outputs the laser light L. The charged surface of the photosensitive member 1 is exposed to the laser light L along a main scan direction at an exposure position b. By repeating the exposure along the main scan direction during the rotation of the photosensitive member 1, of the charged surface of the photosensitive member 1, a portion irradiated with the laser light L is lowered in potential, so that an electrostatic latent image is formed correspondingly to the image information.

Figure 8:
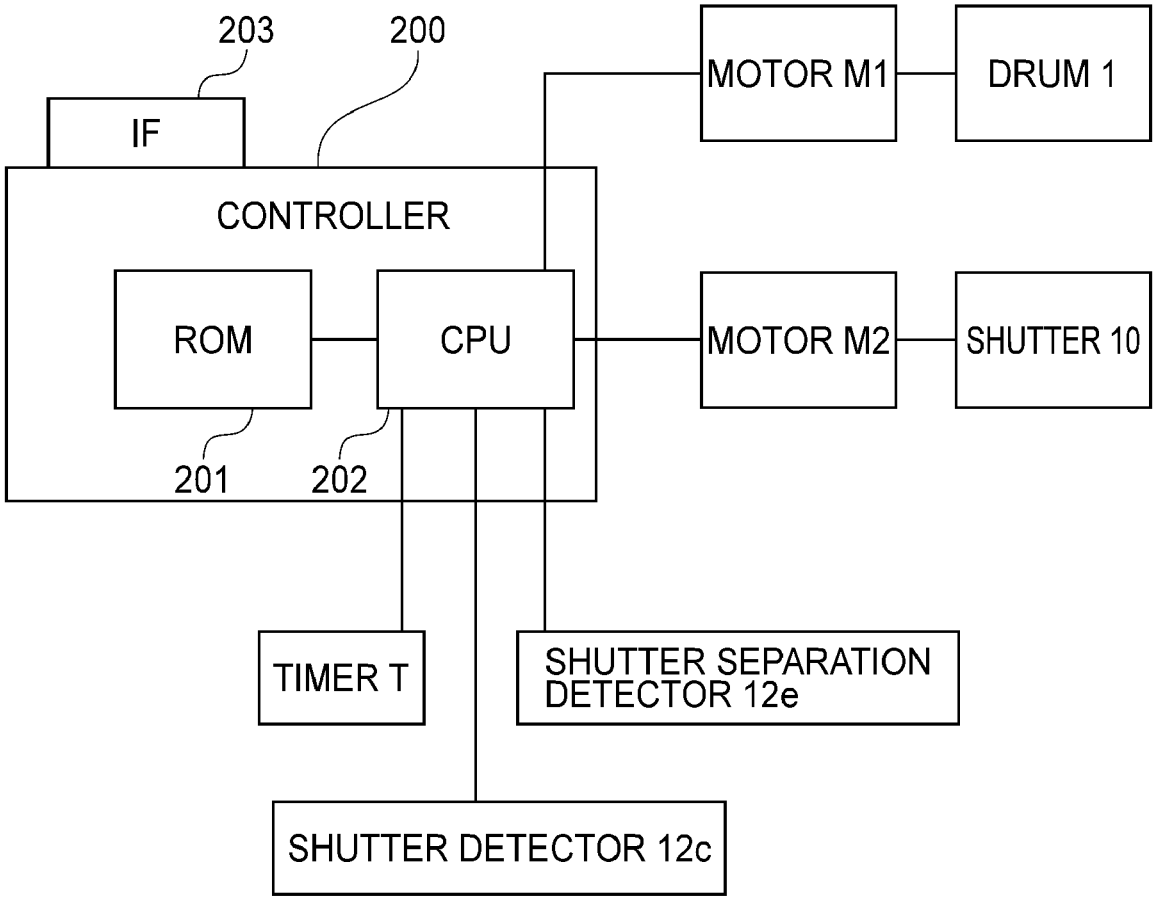
FIG. 8 is a block diagram for illustrating image formation control.

Incidentally, the above-described signals contain, in addition to the information on the image to be formed, information on the number of sheets to be subjected to the image formation and information on start of the image formation, and the like. These signals are input into an interface (IF) portion 203 (FIG. 8). In the case where the image formation is started on the basis of the signal containing the image information, the image information signal takes the place of the image formation start signal. In the case where the image forming apparatus is used as a copying machine, image information of an original read by an original image reader mounted in the image forming apparatus is input into the interface 203. In this case, the signal for starting the image formation is sent to a CPU 202 (FIG. 8) as a control circuit by pushing a start key of an operating portion provided to the image forming apparatus by an operator (user). Further, the number of sheets to be subjected to the image formation is set through a numeric keypad by the operator. Here, the main scan direction means a direction parallel to the generatrix of the mechanism 1 and a sub-scan direction means a direction parallel to the rotational direction of the photosensitive member 1.

(Developing Device)

The developing device 4 deposits a developer (toner) on the electrostatic latent image formed on the photosensitive member 1 by the charging device 2 and the image exposure device 3 to visualize the latent image. The developing device in this embodiment employs a two component magnetic brush developing method and also employs a reverse developing method. The developing device 4 includes a developing container 4*a*, a developing sleeve 4*b*, a magnet 4*c*, a developing blade 4*d*, a developer stirring member 4*f*, and a toner hopper 4*g*. A two component developer 4*e* is accommodated in the developing container 4*a*. The developing sleeve 4*b* is a non-magnetic cylindrical member and is rotatably provided to the developing container 4*a* while a part of an outer peripheral surface thereof is outwardly exposed. The magnet 4*c* is provided in the developing sleeve 4*b* in a state in which it is non-rotatable and fixed. The developing blade 4*d* regulates a thickness of the two component developer 4*e* coated on the developing sleeve surface. The developer stirring member 4*f* is disposed on a bottom side in the developing container 4*a* and feeds the two component developer 4*e* toward the developing sleeve 4*b* while stirring the developer. The toner hopper 4*g* is a container containing toner to be supplied to the developing container 4*a*. The two component developer 4*e* in the developing container 4*a* is a mixture of the toner and a magnetic carrier and is stirred by the developer stirring member 4*f*. The magnetic carrier has a resistance of about $10^{13}$ ohm·cm and a particle size of 40 μm. The toner is triboelectrically charged to a negative polarity by rubbing with the carrier. The above-described developing sleeve 4*b* is disposed oppositely to the photosensitive member 1 so as to provide the closest distance of 350 μm from the photosensitive member 1. A portion at which the photosensitive member 1 and the developing sleeve 4*b* oppose each other constitutes a developing portion c. The developing sleeve 4*b* is rotationally driven so that a movement direction of its surface is opposite from the movement direction of the photosensitive member 1 surface at the developing portion c. That is, the developing sleeve 4*b* is rotationally driven in a direction indicated by an arrow R4 with respect to the arrow R1 direction of the photosensitive member 1. A part of the two component developer 4*e* in the developing container 4*a* is held as a magnetic brush layer at the outer peripheral surface of the developing sleeve 4*b* by a magnetic force of the inner magnet 4*c* and is fed to the developing portion c by the rotation of the developing sleeve 4*b*. The magnetic brush layer is regulated as a predetermined thin layer by the developing blade 4*d*, so that the layer contacts the photosensitive member 1 at the developing portion c.

To the developing sleeve 4*b*, a developing bias application source S2 is connected, and the toner in the developer carried on the surface of the developing sleeve 4*b* is selectively deposited correspondingly to the electrostatic latent image on the photosensitive member 1 by an electric field generated by a developing bias applied from the application source S2. As a result, the electrostatic latent image is developed as the toner image. In this embodiment, the toner is deposited at an exposed portion (laser light irradiation portion) on the photosensitive member 1, so that the electrostatic latent image is reversely developed. At this time, a charge amount of the toner subjected to the development on the photosensitive member 1 is about −25 μC/g. The developer on the developing sleeve 4*b* having passed through the developing portion c is collected in the developing container 4*a* by subsequent rotation of the developing sleeve 4*b*.

Further, in order to keep the toner content of the two component developer 4*e* in the developing container 4*a* in a substantially constant range, an optical toner content sensor is provided in the developing container 4*a*. The toner in an amount corresponding to the toner content detected by the toner content sensor is supplied from the toner hopper 4*g* to the developing container 4*a*.

(Transfer Device)

The transfer device 5 in this embodiment includes a transfer roller 5 as shown in FIG. 4. The transfer roller 5 is urged against the surface of the photosensitive member 1 with a predetermined urging force to form a nip therebetween as a transfer portion d. To the transfer portion d, the recording material P (e.g., paper or a transparent film) is sent from a sheet-feeding cassette with predetermined control timing.

The recording material P sent to the transfer d is subjected to transfer of the toner image formed on the photosensitive member 1 while being nip-conveyed between the photosensitive member 1 and the transfer roller 5. At this time, to the transfer roller 5, a transfer bias (+2 KV in this embodiment) of an opposite polarity to the normal charge polarity (negative) of the toner is applied from a transfer bias application source S3.

(Fixing Device)

The fixing device 6 in this embodiment includes a fixing roller 6*a* and a pressing roller 6*b* as shown in FIG. 4. The recording material P on which the toner image is transferred by the transfer device 5 is conveyed to the fixing device in which the toner image is heated and pressed between the fixing roller 6*a* and the pressing roller 6*b* to be fixed on the recording material P. The recording material P subjected to the fixing is then discharged outside the image forming apparatus.

(Cleaning Device)

The cleaning device 8 in this embodiment includes, as shown in FIG. 4, the cleaning blade. After the toner image is transferred on the recording material P by the transfer device 5, untransferred toner remaining on the photosensitive member 1 surface is removed by the cleaning blade.

(Optical Discharging Device)

The optical discharging device 9 in this embodiment includes, as shown in FIG. 4, a discharging exposure lamp. Residual charges remaining on the surface of the photosensitive member 1 subjected to the cleaning by the cleaning device 8 are removed by light irradiation by the discharging exposure lamp.

A series of the image forming process described above is completed and the image forming apparatus prepares for a subsequent image forming process.

Then, a charger shutter 10 as a sheet-like member for covering and uncovering the opening of the corona charger 2 with respect to the photosensitive member 1 will be described.

(Charger Shutter)

Figure 6:
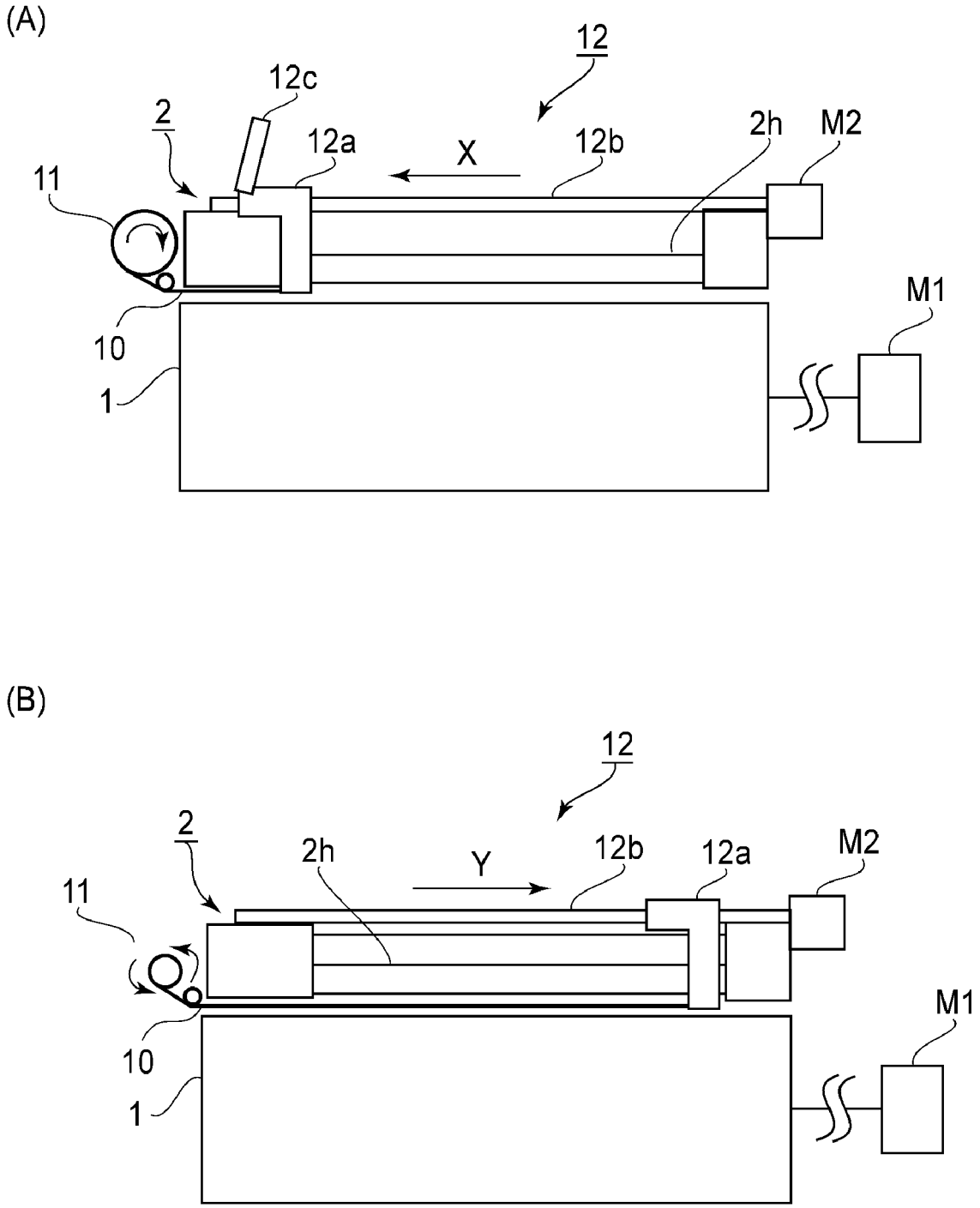
FIG. 6(A) is a schematic sectional view showing a charger shutter is opened and FIG. 6(B) is a schematic sectional view showing a state in which the charger shutter is closed.

FIG. 6(A) shows a state in which the charger shutter as the sheet-like member is opened by being wound up so as to move in the X direction (a state in which the opening of the corona charger 2 opposes the photosensitive member 1). FIG. 6(B) shows a state in which the charger shutter 10 is closed by being moved in the Y direction (a state in which the opening does not oppose the photosensitive member 1).

In this embodiment, as described above, a sheet-like shutter (sheet-like member) capable of being wound up in a roll shape by a winding-up mechanism 11 is employed as the charger shutter 10 for covering and uncovering the opening of the corona charger 2. This is because it is possible to prevent not only the corona discharge product falling from the corona charger 2 onto the photosensitive member 1 from passing through the opening but also the photosensitive member 1 from being damaged to cause image defect by the charger shutter 10 when the charger shutter 10 contacts the photosensitive member 1. In this embodiment, as the charger shutter 10, a 30 μm-thick sheet-like member formed of polyimide resin is employed. Incidentally, as the charger shutter 10, in addition to the above-described resin sheet, it is also possible to employ nonwoven fabric or the like which is less liable to damage the photosensitive member 1.

Further, in this embodiment, for the purpose of reducing a space during retraction (opening) of the charger shutter 10, a constitution in which the charger shutter 10 is wound up in a roll shape on one longitudinal end side (on one main scan direction end side) of the corona charger 2 to be retracted is employed.

(Charger Shutter Opening/Closing Mechanism)

With reference to FIGS. 6(A), 6(B), 7(A), 7(B) and 7(C), an opening/closing mechanism for the charger shutter 10 will be described. FIGS. 6(A) and 7(B) show, as described above, the states in which the charger shutter 10 is in the open position and the closed position, respectively. FIG. 7(A) is a schematic sectional view of the corona charger 2 as seen in the longitudinal direction, FIG. 7(B) shows a moving device 12 for moving the charger shutter 2 to be opened and closed, and FIG. 7(C) shows the winding-up mechanism 11 for winding up the charger shutter 10. In this embodiment, the moving device 12 and the winding-up mechanism 11 function as the opening/closing mechanism for the charger shutter 10.

(Charger Shutter Moving Mechanism)

The moving mechanism 12 includes a driving motor M2, a movable member 12*a*, a rotatable member 12*b*, and a connecting member 12*d* and performs the function of moving the charger shutter 10 along the longitudinal direction (the main scan direction) of the charger shutter 10 so as to be opened and closed.

In this embodiment, a shutter open detecting device 12*c* for detecting completion of an opening operation of the charger shutter 10 is provided. The shutter open detecting device 12*c* includes a photo-interruptor. When the movable member 12*a* reaches the opening operation completion position, the opening operation completion of the opening operation completion of the charger shutter 10 is detected by utilizing light-blocking of the photo-interrupter by the movable member 12*a*. That is, at the time when the shutter open detecting device 12*c* detects the movable member 12*a*, the rotation of the motor M2 is stopped.

One end of the charger shutter 10 is, as shown in FIGS. 6(A) and 6(B), connected to the movable member 12*a*. The movable member 12*a* is driving connected to the rotatable member 12*b* and is formed integrally with the connecting member 12*d*.

The rotatable member 12*b* is provided with a spiral groove as shown in FIG. 7(B) and is connected to the driving motor M2 as shown in FIGS. 6(A) and 6(B). When the rotatable member 12*b* is rotationally driven by the driving motor M2, the connecting member 12*d* threadably mounted on the rotatable member 12*b* moves in the main scan direction (X or Y direction) along the spiral groove. The connecting member 12*d* is threadably mounted on the rotatable member 12*b* so as to be movable only in the main scan direction on a rail provided on the shield 2*b*, thus being prevented from rotating together with the rotatable member 12*b*. Specifically, a recess portion provided at both end portions of the connecting member 12*d* as shown in FIG. 7(B) is engaged with the rail.

Therefore, when the rotatable member 12*b* is driven by the driving motor M2, through the movable member 12*a* formed integrally with the connecting member 12*d*, a moving force toward the opening/closing direction is transmitted to the charger shutter 10. As a result, the charger shutter 10 is movable between the closed position in which the opening of the corona charger 2 is placed in a shielding state and the open position in which the opening is placed in an uncovered (non-shielding) state.

(Charging Shutter Winding-Up Mechanism)

In this embodiment, the winding-up mechanism 11 for winding up the charger shutter 10 in interrelation with the movement of the charger shutter 10 in the opening direction (X direction) by the moving mechanism 12 is employed. This is because the charger shutter 10 can be prevented from loosening toward the photosensitive member 1 side in interrelation with the movement of the charger shutter 10 by the moving mechanism 12.

Specifically, as shown in FIG. 7(C), the winding-up mechanism 11, a winding-up roller (winding-up member) 11*b* for fixing one end of the charger shutter 10 and for winding up the charger shutter 10 and includes a spring (urging member) 11*a* provided in the winding-up roller 11*b*.

The winding-up roller 11*b* includes a roller body rotatable about a shaft member 11*d* to wind up the charger shutter 10 about its outer peripheral surface and includes a fixed roller 11*c* which is fixed to the shaft member 11*c* in a non-rotatable manner. One end of the spring 11*a* provided so that the shaft member 11*d* passes through the spring 11*a* is fixed to the roller body and the other end of the spring 11*a* is fixed to the fixed roller 11*c*. Therefore, at both end portions of the spring 11*a*, by the rotation of the winding-up roller 11*b*, bending stress due to torsion is applied to the spring 11*a*.

Accordingly, when the charger shutter 10 is opened (FIG. 6(A)), in interrelation with the movement of the charger shutter 10 in the X direction by the motor M2, the winding-up roller 11*b* winds up the charger shutter 10 at any time. That is, the charger shutter 10 is placed in a state in which it is always urged in the X direction by the spring 11*a* in the winding-up roller 11*b* with an urging force.

Therefore, when the charger shutter 10 is placed in the open position (FIG. 6(A)), by the urging force toward the X direction by the spring 11*a* in the winding-up roller 11*b*, the charger shutter 10 is placed in the tension state to some extent. As a result, when the charger shutter 10 is opened, it is possible to keep a state in which the corona discharge product is less liable to leak from a gap between the charger shutter 10 and the corona charger 2 toward the outside the corona charger 2.

On the other hand, when the charger shutter 10 is closed (FIG. 6(B)), the driving motor M2 pulls the charger shutter 10 from the winding-up roller 11*b* against the urging force of the spring 11*a* in the winding-up roller 11*b*, so that the charger shutter 10 is moved in the Y direction.

(Control Flow During Image Formation Start)

As described above, when the charger shutter 10 is located at the open position (in the state of FIG. 6(A)), by the urging force toward the X direction by the spring 11*a* in the winding-up roller 11*b*, the charger shutter 10 is under tension to some extent.

However, in the where the charger shutter 11 is closed after the state in which the charger shutter 10 is opened (in the state of FIG. 6(A)) for a long time by continuously repeating the image formation, the following problem can arise. That is, an a portion (FIG. 11(A)) in the neighborhood of a longitudinal central portion of the charger shutter 10 is bent toward the photosensitive member 1 side due to core set by the winding-up mechanism 11. When a degree of this bending is large, the charger shutter 10 contacts the photosensitive member 1.

In such a state, when the photosensitive member is rotated, the charger shutter is dragged in the circumferential direction of the photosensitive member by the rotation of the photosensitive member, so that the charger shutter can be broken. This inconvenience can be obviated by employing a constitution in which the rotation of the photosensitive member is started after the opening operation of the charger shutter is completed. However, such a constitution is accompanied with another problem. That is, a time from input of an image formation start signal until the image formation on a first sheet is unnecessarily increased. That is, the above constitution cannot meet needs of a user who wishes to complete the image formation in a short time, thus lowering usability.

Further, the above-described bending of the charger shutter placed in the closed state can be obviated by increasing the tension applied to the charger shutter but in this case, there also arises a further problem. That is, the sheet-like member is used as the charger shutter, so that the charger shutter is elongated in its longitudinal direction when the applied tension is increased. When the elongation occurs, the charger shutter cannot be wound up completely by the winding-up mechanism, so that the charger shutter can contact the photosensitive member or can decrease in length with respect to a widthwise (lateral) direction of the charger shutter, thus failing to shield the opening of the corona charger.

In view of the above problems, in this embodiment, the rotation of the photosensitive member is started at a predetermined time in a period from the start of the opening operation of the charger shutter to a time before the completion of the opening operation.

Specifically, at a time after a lapse of a period from the time when the opening operation of the charger shutter is started to the time when the bent portion of the charger shutter is retracted (separated) from the photosensitive member, the rotation of the photosensitive member is started before the opening operation is completed.

Figure 9:
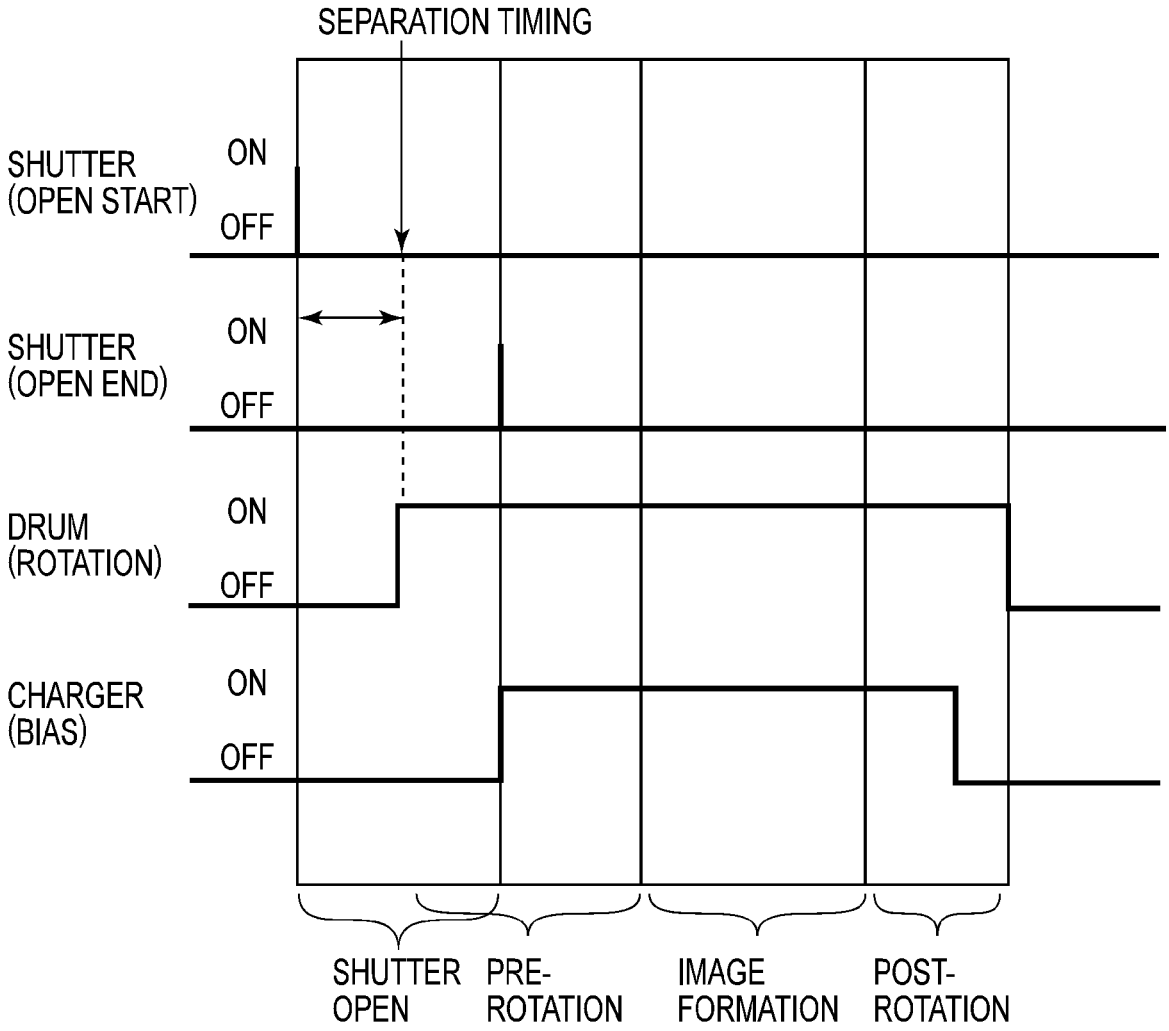
FIG. 9 is a time chart at the time of starting the image formation.

This is shown in a time chart of FIG. 9. FIG. 8 is a block diagram for illustrating control of the image forming portion and various devices are controlled by a controller 200 in accordance with the time chart of FIG. 9.

First, in accordance with an image forming start signal input into the interface (IF) portion 203, an opening operation start signal is sent so that the opening operation of the charger shutter 10 is started. That is, the rotation of the motor M2 is started. An elapsed time from the time of starting the opening operation is counted by a timer T as a measuring means. When the time measured by the timer T reaches a set time (3 seconds in this embodiment), an rotating operation of the photosensitive member 1 is started. That is, the rotation of the motor M1 (FIGS. 6(A), 6(B)) is started.

Figure 11:
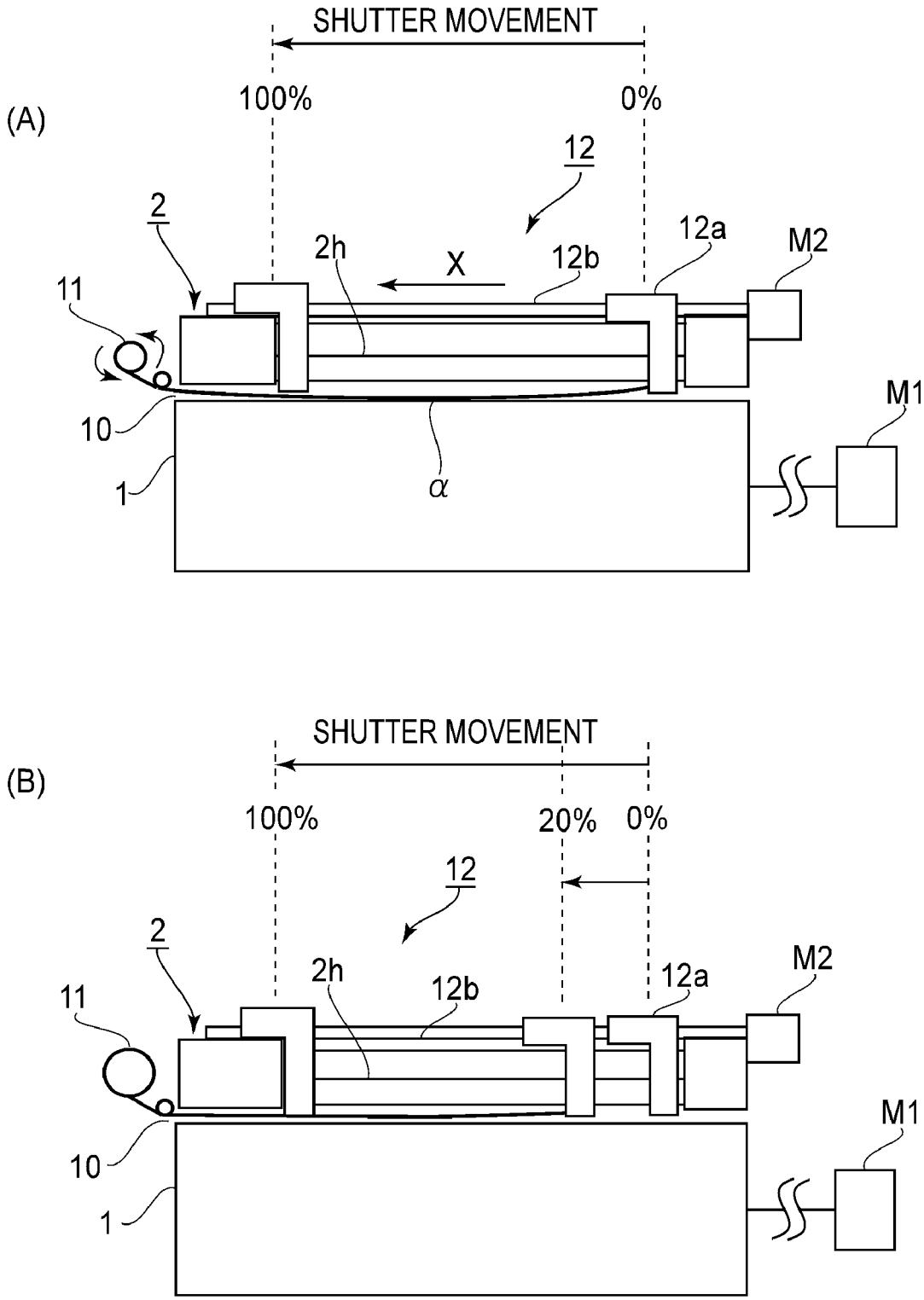
FIG. 11(A) is a schematic sectional view showing a state in which the charger shutter contacts the mechanism due to bending of the charger shutter and FIG. 11(B) is a schematic sectional view showing a state in which the charger shutter is separated from the photosensitive member in interrelation with an opening operation of the charger shutter.

The set time is preset as a time when the central portion ($\alpha$ portion in FIG. 11(A)) of the charger shutter is separated from the photosensitive member. This set time is stored in a ROM 201. The CPU 202 effects control by which the rotating operation of the photosensitive member is started by reading the time stored in the ROM 201.

By the rotation start of the photosensitive member, a pre-process for preparing for image formation (image output), i.e., a so-called pre-rotation is started appropriately. In the pre-rotation, preparatory operations of various devices functioning as the image forming means including the image exposure device, the developing device, the optical discharging device, and the like are performed.

When the shutter open detecting device 12*c* detects that the charger shutter has reached the open position, the CPU 202 having received the detection information completes the opening operation of the charger shutter. That is, the rotation of the motor M2 is stopped. By the completion of the opening operation of the charger shutter, application of the charging bias to the corona charger 2 is started. Specifically, the application of the charging bias to the discharging wires 2*h* and the grid electrode 2*a* is started.

When the pre-process is completed, the image formation is started. Specifically, image exposure by the image exposure device is started. Then, when the image formation on a required number of sheets is completed, a post-process, i.e., a so-called post-rotation is started. In the post-process, a post-process operation, required to effect subsequent image formation, for stopping the respective image forming devices is performed.

When this post-process operation is completed, the rotating operation of the photosensitive member is stopped. That is, the rotation of the motor M1 is stopped. At this time, by rotating the motor M2, the closing operation of the charger shutter is performed.

Figure 10:
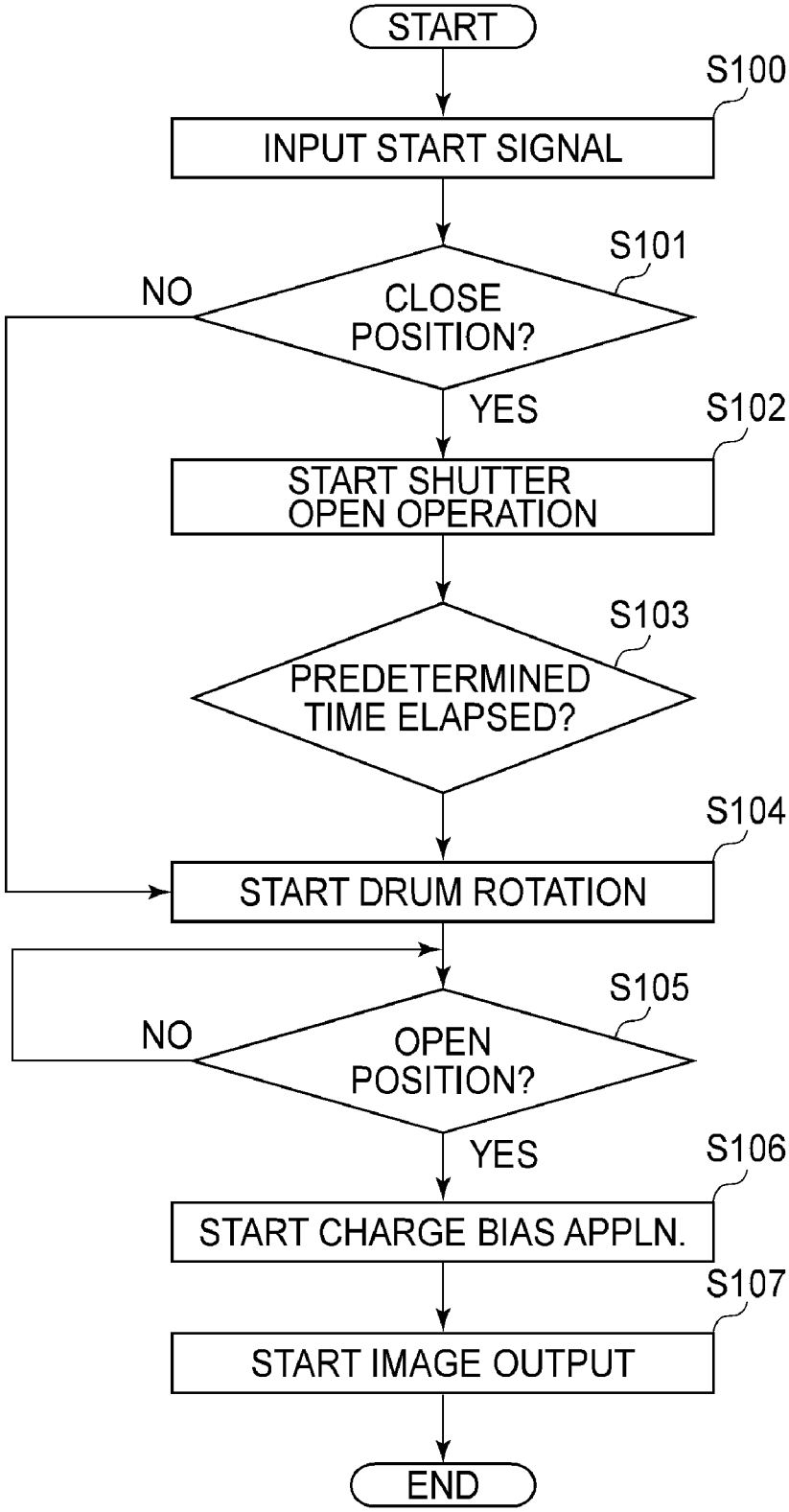
FIG. 10 is a flowchart for illustrating the image formation.

The above-described series of flow will be described along the flow chart of FIG. 10. The respective devices are controlled along the flow by the controller 200 so as to be operated.

First, when the image formation start signal is input (S100), based on an output of the shutter open detecting device 12*c*, judgment as to whether or not the charger shutter 10 is located at the closed position is made (S101). In this embodiment, when the output indicates that the charger shutter 10 is located at the open position, the charger shutter 10 is judged as being located at the open position. When the output indicates that the charger shutter 10 is not located at the open position, the charger shutter 10 is judged as being located at the closed position.

Then, in the case where the output of the shutter open detecting device 12*c* indicates that the charger shutter 10 is not located at the open position, i.e., that the charger shutter 10 is located at the closed position, the opening operation of the charger shutter 10 is started (S102).

Then, the elapsed time from the start of the opening operation of the charger shutter 10 is judged as to whether or not it reaches a predetermined time (S103). This judgment is repeated until the elapsed time reaches the predetermined time.

Thereafter, when the elapsed time from the opening operation start of the charger shutter 10 reaches the predetermined time, the rotating operation of the photosensitive member 1 is started (S104).

Then, based on the output of the shutter open detecting device 12*c*, whether or not the charger shutter 10 reaches the open position is judged (S105). This judgment is repeated until the charger shutter 10 reaches the open position.

Thereafter, when the charger shutter 10 reaches the open position, the charging bias is applied to the corona charger 2 (S106). Then, when the above-described pre-process is completed, image output (image formation) is started (S107).

When the series of the image forming process is completed, the post-process is performed. Then, the closing operation of the charger shutter 10 is started by the completion of the post-process, so that the charger shutter 10 is closed.

Incidentally, in S101, in the case where the charger shutter 10 is judged as being located at the open position, the rotating operation of the photosensitive member 1 is started immediately (S104). The subsequent flow is similar to that described above.

As described above, in this embodiment, the rotating operation of the photosensitive member is started before the opening operation of the charger shutter is completed, so that the period in which the pre-process of the respective image forming devices is performed can be moved up compared with the conventional constitution in which the pre-process is performed after the opening operation is completed.

Therefore, it is possible to reduce the time required for the image formation as small as possible while the breakage of the charger shutter is prevented. That is, a time from the input of the image formation start signal until the first sheet is discharged outside the image forming apparatus, i.e., a so-called first copy time (FCOT) can be reduced. As a result, it is possible to provide an image forming apparatus with high usability.

(Verification)

Here, verification of the set time from the opening operation start of the charger shutter 10 to the rotating operation start of the photosensitive member 1 will be conducted.

In FIG. 11(A), a moving distance of the charger shutter 10 when the charger shutter 10 is located at the closed position before the opening operation of the charger shutter 10 is performed is taken as a reference distance (0%). Further, the moving distance of the charger shutter 10 when the charger shutter 10 is located at the open position is taken as 100%.

As described above, FIG. 11(A) shows the state in which the α portion in the neighborhood of the longitudinal central portion of the charger shutter 10 has been bent downwardly by gravitation due to the long-time retention of the charger shutter 10 at the closed position. As a result, the α portion of the charger shutter 10 has contacted the photosensitive member 1.

The present inventor has conducted a verification experiment as to the time when the α portion is separated from the photosensitive member 1. The results are summarized in Table 1 showing a relationship among the moving distance (%) of the charger shutter, an occurrence of contact between the charger shutter and the photosensitive member, and the set time. The set time (sec) is the time required for the charger shutter movement and corresponds to the time when the rotating operation of the photosensitive member is started for the above-described image formation.

TABLE 1

| MOVING DISTANCE (%) | CONTACT | SET TIME (sec) |
|---|---|---|
| 0 | YES | — |
| 5 | YES | — |
| 10 | YES | — |
| 15 | YES | — |
| 20 | NO | 3.0 |
| 50 | NO | 7.5 |
| 80 | NO | 12.0 |
| 100 | NO | 15.0 |

As is understood from the results of Table 1, at the time when the moving distance of the charger shutter is 20%, the charger shutter is started to separate from the photosensitive member. This may be attributable to the following phenomenon. That is, when the charger shutter is started to its opening operation, a closing range (facing the photosensitive member) of the charger shutter with respect to the X direction is gradually narrowed. In other words, a range in which the charger shutter can be bent is gradually narrowed, so that a portion at which there is a possibility of the contact of the charger shutter with the photosensitive member can be eliminated. The resultant separated state is shown in FIG. 11(B).

Therefore, it is understood that the rotating operation of the photosensitive member may be started at the time when or after the moving distance of the charger shutter reaches 20%.

That is, in order to reduce the time required for the image formation on the first sheet as small as possible, the rotating operation of the photosensitive member may be started at the time when the moving distance of the charger shutter reaches 20% (after 3 seconds from the start of the opening operation of the charger shutter).

As a result, compared with the case where the photosensitive member rotating operation is started at the time when the moving distance of the charger shutter reaches 100% (after 15 seconds from the start of the charger shutter opening operation), it is possible to bring about an advantage of 12 seconds. The time of 12 seconds is of significant importance for the reduction in FCOT, thus considerably contributing to the improvement in usability.

Figure 12:
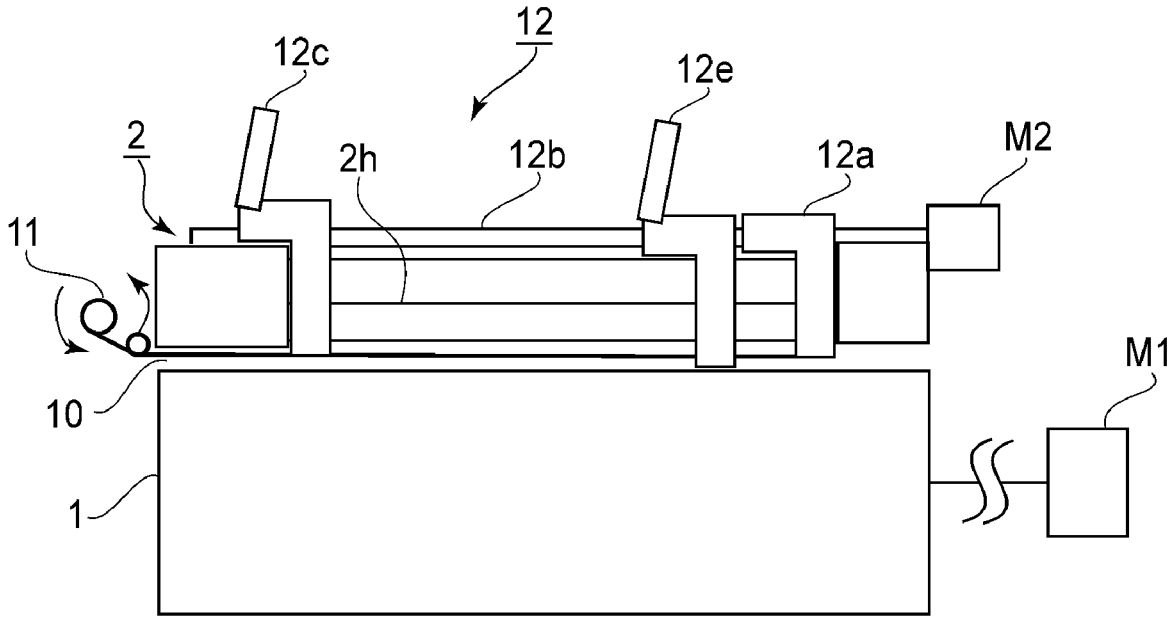
FIG. 12 is a schematic sectional view showing a state in which a position detecting device for the charger shutter is provided.

In this embodiment, the timing of starting the photosensitive member rotating operation on the basis of the time measured by the timer T is controlled but as shown in FIG. 12, it is also possible to employ a constitution in which the timing is controlled on the basis of the position of the charger shutter. In this case, a block diagram is identical to that shown in FIG. 8 except that the timer T is removed.

Specifically, a shutter separation detecting device 12*e* as a position detecting means is provided at a set position (predetermined position) at which the moving distance of the charger shutter reaches 20%. On the basis of an output of the shutter separation detecting device 12*e*, the CPU 202 effects control. That is, when the CPU 202 receives a signal, indicating that the charger shutter reaches the set position, from the shutter separation detecting device 12*e*, the CPU 202 actuates the motor M1 in order to start the photosensitive member rotating operation. Incidentally, the shutter separation detecting device 12*e* includes a photo-interrupter and detects the position of the charger shutter by utilizing shielding thereof by the movable member 12*a* when the movable member 12*a* reaches the set position. Also in the constitution in which the timing of starting the photosensitive member rotating operation is controlled on the basis of the position of the charger shutter, it is possible to achieve the effect of the present invention similarly as in the above-described embodiment.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 284514/2008 filed Nov. 5, 2008, which is hereby incorporated by reference.

What is claimed is:

1. An image forming apparatus comprising:

a photosensitive member;

a corona charger, provided with an opening opposing said photosensitive member, for electrically charging said photosensitive member;

an image forming portion for forming an image on said photosensitive member electrically charged by said corona charger;

a sheet-like member movable to a close position where the opening of said corona charger is closed by moving in an axial direction of said photosensitive member and to an open position where the opening of said corona charger is opened by moving in the axial direction of said photosensitive member; and a controller for controlling drive of said photosensitive member so that the drive of said photosensitive member is started, with a start of image formation, after a start of movement of said sheet-like member from the closed position and before completion of movement of said sheet-like member to the open position.

2. An apparatus according to claim 1, further comprising measuring means for measuring a time elapsed from a start of an opening operation of said sheet-like member, wherein said controller controls the rotating operation of said photosensitive member on the basis of an output of said measuring means.

3. An apparatus according to claim 1, further comprising position detecting means for detecting that said sheet-like member reaches a predetermined position between the closed position and the open position, wherein said control means controls the rotating operation of said photosensitive member on the basis of an output of said position detecting means.

4. An apparatus according to claim 1, wherein the charging by said corona charger is started simultaneously with completion of an opening operation of said sheet-like member.

5. An apparatus according to claim 1, further comprising a winding-up mechanism including an urging member for imparting an urging force to said sheet-like member in order to wind up said sheet-like member in interrelation with an opening operation of said sheet-like member.

* * * * *